United States Patent [19]

Engelman et al.

[11] Patent Number: 4,741,378

[45] Date of Patent: May 3, 1988

[54] SPRUE PIN FOR PRODUCING CASTINGS

[75] Inventors: Melvin A. Engelman, Wappingers Falls; Victor Zamaloff, Poughkeepsie; Lori D. Cooke, Hyde Park, all of N.Y.

[73] Assignee: Dentifax International, Inc., Wappingers Falls, N.Y.

[21] Appl. No.: 778,196

[22] Filed: Sep. 20, 1985

[51] Int. Cl.[4] ..... B22C 7/02; B22C 9/04

[52] U.S. Cl. ..... 164/244; 164/35; 249/54; 249/62

[58] Field of Search ..... 164/244, 246, 34, 35, 164/36, 45, DIG. 4; 249/54, 62

[56] References Cited

U.S. PATENT DOCUMENTS

| | | | |
|---|---|---|---|
| 996,978 | 7/1911 | Curl | 164/244 |
| 3,340,923 | 9/1967 | Benfield | 164/244 |
| 3,610,317 | 10/1971 | Benfield et al. | 164/244 X |
| 4,081,019 | 3/1978 | Kulig | 164/244 X |

*Primary Examiner*—Nicholas P. Godici
*Assistant Examiner*—J. Reed Batten, Jr.
*Attorney, Agent, or Firm*—Schmeiser, Morelle & Watts

[57] ABSTRACT

An improved sprue pin for producing castings by the lost wax method wherein the sprue pin gradually decreases in external circumference toward the tip of the sprue. The length and gauge of the sprue is such that it provides acceptable flow rates and solidification times for new base metal and palladium alloys. A set of lines about the circumferentially decreasing tip allows the user to conform the sprue to the size of the wax pattern being used to form the casting.

7 Claims, 1 Drawing Sheet

SPRUE PIN FOR PRODUCING CASTINGS

FIELD OF THE INVENTION

Generally, this invention relates to devices for producing castings by the lost wax method. More specifically, this invention relates to sprue pins used in the production of such castings.

BACKGROUND OF THE INVENTION

The production of cast dental restorations by the lost wax method is well known. This method generally involves the production of a wax pattern configured to match the desired restoration. This pattern is attached to a support commonly known as a sprue and the sprue is, in turn, secured to a base member.

The sprue, base member and wax pattern are placed within a container which is therafter filled with investment. After the investment has set, it is heated in order to melt the sprue and wax pattern which flow out of the investment through the opening created by the sprue and base, thereby leaving a passageway and cavity within the investment.

Molten alloys are then directed through the passageway created by the sprue and into the casting cavity created by the wax pattern. As the alloy solidifies, a casting is produced which is a duplicate of the original wax pattern.

In order to produce a a good casting, a variety of sprue assemblies have been developed. These various assemblies generally seek to create a smooth passageway so that the alloy may flow therethrough without turbulence which would cause porosity in the finished casting. In order to obtain a smooth passageway, plastic sprues, which burn out, were utilized. However, it was soon observed that when melting the plastic sprues, they would curl in such a manner that the investment wall along the passageway would be chipped or otherwise marked. In order to overcome this, hollow sprue pins wee developed which provided sufficient area for the melting plastic to curl inwardly, thereby avoiding the creation of excess pressure and subsequent marring of the passageway walls.

Another problem encountered relates to the shrinkage of the alloy as it cools. When the molten alloy filling the casting cavity cools, shrinkage occurs. In order to avoid irregularities in the final casting, there needs to be a source of molten alloy which can be drawn into the pattern cavity as the contents cool. To provide this source of molten alloy, sprue pins were formed with a bulbous area at a point toward the tip so as to create a reservoir of molten alloy within the investment. This alloy reservoir, being larger in size would solidify after the alloy within the cavity, thereby serving as a source of additional molten alloy to compensate for the shrinkage within the cavity.

It has been found, however, that even though the reservoir may contain molten alloy sufficient to compensate for shrinkage within the cavity, blockages often form which prevent alloy flow from the reservoir. Also, with the use of different alloys, the flow rates and solidifying times often vary from those established for high gold alloys. Thus, irregularities may occur with a new alloy that would not have occurred if high gold alloys were used.

During the development of the subject invention, it was therefore an object to provide a sprue pin which would allow for the flow of additional molten alloy to the pattern cavity during cooling.

Another object of this invention was to provide a sprue pin suitable for alloys which have different fluidity and different solidifying times.

A still further object of this invention was to provide a sprue pin which is sufficiently versatile to be effective with a variety of pattern sizes.

A still further object of this invention was to provide a sprue pin having a cavity and passageway structure that allows for gradual cooling in a predetermined sequence.

Other objects and advantages may be observed as the detailed description and drawings are considered as well as through practice with the invention.

SUMMARY OF THE INVENTION

It has been found that the various objects of this invention may be accomplished through the use of a hollow sprue pin having a bulbous extension about it wherein the end of the sprue pin which attaches to the wax pattern gradually decreases in external circumference toward the tip. The tip having a circumference of 50% to 75% of the initial sprue circumference. The sprue pin can vary in length and gauge making it extremely usable with specific alloy types: an 8 or 10 gauge sprue pin from 0.35 in. to 0.75 in. is especially suited for high palladium and other noble alloys, while a 10 or 12 gauge sprue pin from 0.5 in. to 0.95 in. is ideal for base metal alloys. The end of the sprue pin which gradually decreases in circumference has markings thereon so as to allow for the severing of the sprue pin along the graduated portion in order to accommodte wax patterns of varying thicknesses. In this way, the sprue can be altered so that the tip of the sprue pin is of a greater circumference than the thickest part of the wax pattern which is the preferred point for joining the sprue to the wax pattern. This guarantees the user that the alloy at the tip of the sprue pin will remain molten for a longer period of time than the alloy within the casting cavity.

By producing a passageway which increases in size as one moves toward the reservoir, the formation of blockages between the cavity and reservoir is prevented. When formation of such a blockage prevents the flow of molten alloy to the cavity during cooling, suction is created within the cavity causing flaws in the casting . By preventing such blockages, the sprue pin of the subject invention produces more flawless castings.

The principles of this invention are incorporated in the preferred embodiment which is disclosed in the accompanying drawings and detailed description.

DETAILED DESCRIPTION OF THE PREFERRED EMBODIMENT(S)

Figure 1:
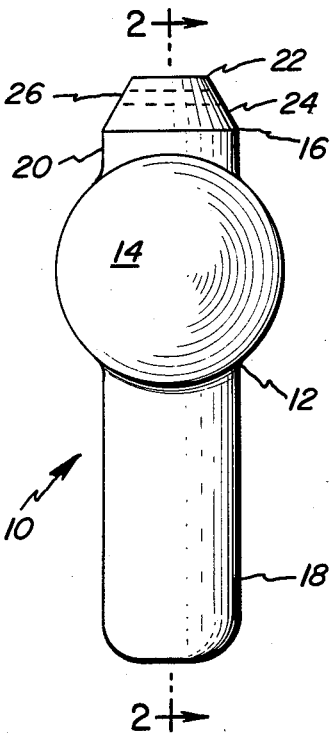
FIG. 1 is an elevational view of the sprue pin showing a bulbous extension for creating a reservoir.

FIG. 1 discloses a sprue pin 10 for use in producing castings by the lost wax process. The sprue pin 10 has an elongated body member 12 which is divided by a bulbous extension 14.

The extension 14 extends totally around the body member and serves to create a reservoir when enveloped in investment material. The extension 14 divides the sprue pin into a tip segment 16 and a stem 18.

The first segment 20 of the tip 16 which is immediately adjacent to the extension 14 is of the same circumference as the stem 18. However, from the first segment 20 to the pattern connecting end 22, the circumference gradually decreases. This gradually decreasing area is referred to as the second segment 24 of the tip 16.

The end 22 ranges from 50% to 75% of the external circumference of the stem 18.

Around the second segment 24 are markings 26 which are used to denote where the second segment 24 should be cut in order to obtain various circumferences.

This enables the user, after determining the thickest portion of the wax pattern which is to be applied to the end of the sprue pin 10, to adjust the circumference of the end 22 so that it is greater than the wax pattern while still being less than the first segment 20. Since the thinner and narrower areas solidify first, this produces a solidification sequence wherein the areas solidifying will always be adjacent to a supply of molten alloy until finally the alloy within the reservoir itself solidifies.

Figure 2:
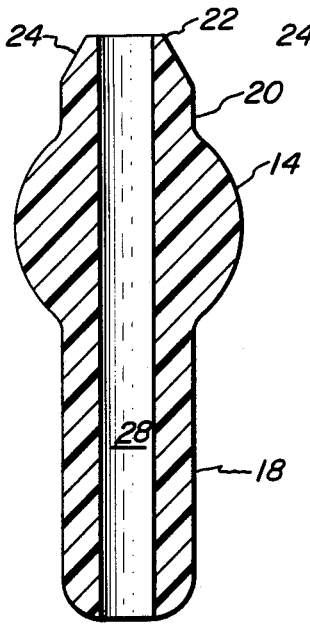
FIG. 2 is a cross-sectional view taken along line 2—2 in FIG. 1 showing the hollow lumen.

FIG. 2 is a cross-sectional view showing the lumen 28 which extends length-wise through the sprue pin to the openings at either end.

Figure 3:
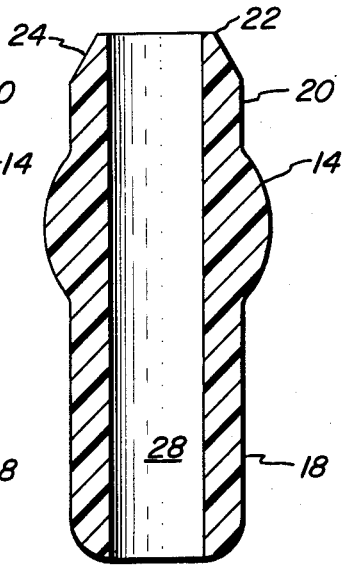
FIG. 3 is an alternate embodiment showing a shorter sprue pin of greater gauge and having a larger central lumen also in cross sectional view.

FIG. 3 is also a cross-sectional view similar to FIG. 2, however, showing a different sprue pin length and gauge. When considered together, FIGS. 2 and 3 represent a range of sprue pin gauges and lengths which were specifically developed to be used with high palladium alloys or base metal alloys. These alloys vary in fluidity, in their molten state, from the high gold alloys which had been commonly used, and they respond differently during solidification. In addition, their solidification time is varied from that of previously hollow sprue pins having a length between 0.35 in. and 0.75 in. and having a gauge between 8 and 10 results in better flow and aids in the prevention of porosity in palladium and other noble alloys; utilizing sprue pins having a length between 0.5 in. and 0.95 in. and a gauge between 10 and 12 results in better flow and aids in the prevention of porosity in base metal castings.

Figure 4:
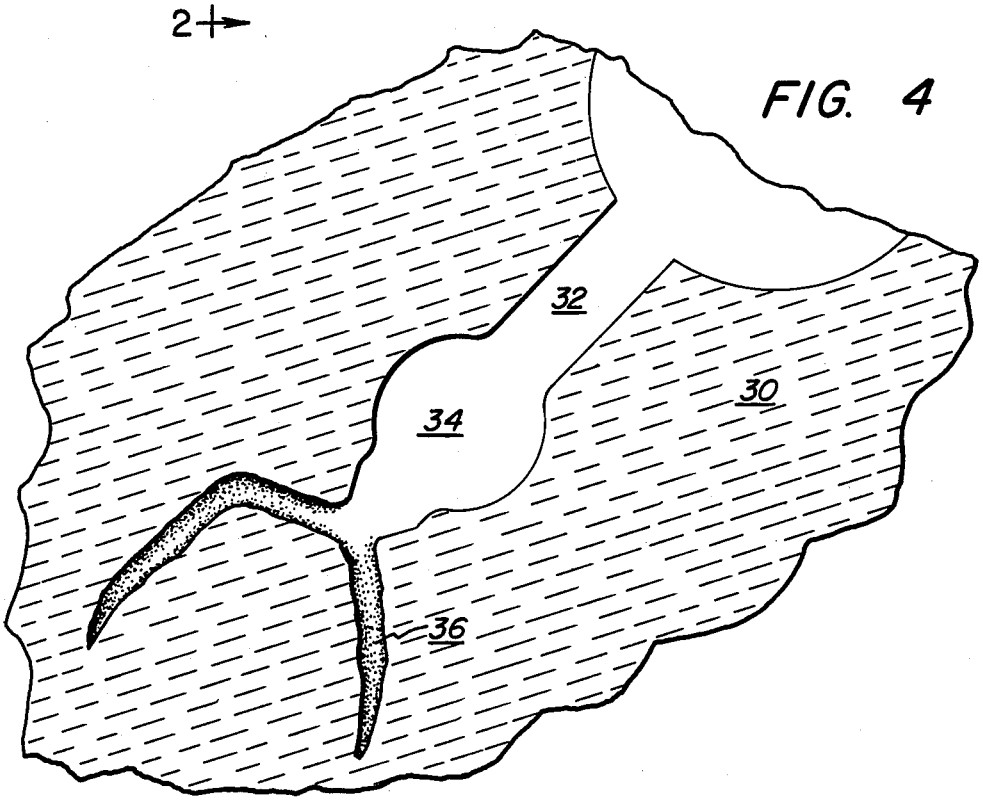
FIG. 4 is a cross-sectional view showing the cavities formed within the investment.

FIG. 4 discloses the chambers created within the investment 30. These consist of a passageway 32 created by the elongated body 12 of the sprue pin 10, and a reservoir 34 created by the extension 14. The cavity 36 created by the wax pattern will determine the shape of the finished castings.

Molten alloys are introduced through the passageway 32 and into the cavity 36, also filling the reservoir 34. Since the thickness of the cavity is less than the passageway created by the second segment 24, the alloy within the cavity will be the first to solidify. As the alloy within the cavity solidifies, shrinkage occurs and molten alloys within the passageway 32 will supply the additional alloy needed. Similarly, molten alloy from the reservoir 34 will resupply the passageway 32.

In addition, since the portion of the passageway created by the second segment 24 is tapered, the alloy will flow into the cavity 36 with less turbulence, thereby avoiding porosity. Should it be found that a pattern will have a thickness greater than the connecting end 22, the user can cut the sprue pin along one of the markings 26 so that the circumference at the connecting end will be greater than the thickness of the pattern, thus assuring solidification in proper sequence.

While the above describes the preferred embodiment of this invention, it will be appreciated by those skilled in the art that variations may be made without departing from the intent of this invention. Similarly, it is anticipated that this invention will be limited only by the appended claims.

We claim:

1. A sprue pin used in the lost wax process for producing castings, comprising:

an elongated body member having a lumen length-wise therethrough; and a bulbous extension around a portion of the body toward one end of the body member, said extension separating the body into a stem segment and a shorter tip segment, the outer circumference of said tip segment gradually decreasing from an area toward the extension to the end of the tip segment, the end of said tip segment defining one end of the lumen and adapted to receive a wax pattern.

2. The invention of claim 1 wherein the tip segment has a first segment immediately adjacent to the extension which is substantially equal in circumference to the stem, the remainder of the tip circumference tapering to one half to three fourths of the stem's circumference; and markings around said tapered area denoting where the tip segment may be cut to obtain a larger end circumference for a proper sequence of solidification.

3. The invention of claim 2 wherein the lumen is of the same diameter throughout its length.

4. The invention of claim 3 wherein the length of the sprue pin is between 0.35 in. and 0.75 in.

5. The invention of claim 4 wherein the stem ranges from 8 gauge to 10 gauge.

6. The invention of claim 3 wherein the length of the sprue pin is between 0.5 in. and 0.95 in.

7. The invention of claim 4 wherein the stem ranges from 10 gauge to 12 gauge.

* * * * *